United States Patent [19]

Hare et al.

[11] 4,007,885

[45] Feb. 15, 1977

[54] FLEXIBLE TRAVERSE GUIDE ASSEMBLY

[75] Inventors: James Weaver Hare, Martinsville, Va.; Allan Bryce Hughes, Wilmington, Del.

[73] Assignee: E. I. Du Pont de Nemours and Company, Wilmington, Del.

[22] Filed: June 17, 1975

[21] Appl. No.: 588,220

[52] U.S. Cl. ..... 242/43 R; 242/43.1; 242/157 R

[51] Int. Cl.[2] ..... B65H 54/28; B65H 57/00

[58] Field of Search ..... 242/43 R, 43.1, 157 R

[56] References Cited

UNITED STATES PATENTS

| | | | |
|---|---|---|---|
| 2,869,797 | 1/1959 | Clerc | 242/43 R |
| 3,097,805 | 7/1963 | Oberly | 242/43 R |
| 3,171,608 | 3/1965 | Speakman | 242/43 R |
| 3,730,448 | 5/1973 | Schippers et al. | 242/43.1 |

FOREIGN PATENTS OR APPLICATIONS

| | | | |
|---|---|---|---|
| 611,586 | 11/1948 | United Kingdom | 242/43 R |
| 954,669 | 4/1964 | United Kingdom | 242/43 R |

*Primary Examiner*—Stanley N. Gilreath

[57] ABSTRACT

A yarn winding apparatus with a rotatably driven barrel cam having a groove in its cylindrical surface and a slide member and traverse guide assembly engaging the groove constrained for reciprocating linear movement, as the cam rotates, is provided with a constant tension yarn laydown at the reversals by incorporating a resilient lever between the guide and the slide head capable of being flexed at the cam reversals within a predetermined critical range of from about 2.5° to about 6.5° with respect to a plane perpendicular to the linear movement of the guide assembly when the slide head moves in a horizontal path.

2 Claims, 6 Drawing Figures

FLEXIBLE TRAVERSE GUIDE ASSEMBLY

BACKGROUND OF THE INVENTION

This invention relates generally to traverse winding of yarn at high speeds and, more particularly, to improvements in the traverse guide assembly which is an integral part of the winding apparatus.

It is well known in the textile field to wind packages of yarn, thread or the like on a bobbin in a traverse winding apparatus. In such an apparatus, the yarn passes through a reciprocating traverse guide to a rotating package. The guide is attached to a follower which rides in a generally helical groove in the surface of a rotatably driven barrel cam and is constrained to follow a reciprocating linear path of travel. Although such apparatus is entirely suitable for use at moderate speeds, it has been found that higher winding speeds lead to the formation of unstable packages having bulged shoulders and overthrown ends. These unacceptable results are caused by the reduction in follower linear velocity in the reversal portion of the cam and the concurrent deposit of surplus yarn at the package ends. In addition to the formation of surplus yarn on the package ends, another problem called overthrown ends, sometimes occurs because there is substantially no lateral movement at the cam reversal of the slide member and traverse guide and consequently no lateral motion of the threadline. This, of course, results in the threadline being fed through the guide at the reversal more rapidly than it can be accommodated by the rotation of the bobbin and slack is formed in the threadline which may, due to the lateral momentum from the traverse stroke, be thrown over the shoulder of the package. These overthrown ends are undesirable because they may cause problems in later unwinding operations.

SUMMARY OF THE INVENTION

The above-described problems are substantially eliminated in a yarn winding apparatus of the type that includes a rotatable driven barrel cam having a continuous helical groove in its surface, a cam follower riding in the groove and means limiting the follower to a reciprocating linear movement between by providing a resilient arm coupled between the cam follower and the yarn guide. The stiffness of the arm is critical. It must be just sufficient to keep constant tension on the yarn. If the flexibility of the arm is too low, the above-described problems are present. If too high, the yarn laydown is not controlled at the reversal (the tension goes slack) and the threadline may jump out of the guide. The flexibility limits of the arm during the cam reversal are from between about 2.5° to about 6.5°.

DETAILED DESCRIPTION OF THE ILLUSTRATED EMBODIMENT

Figure 1:
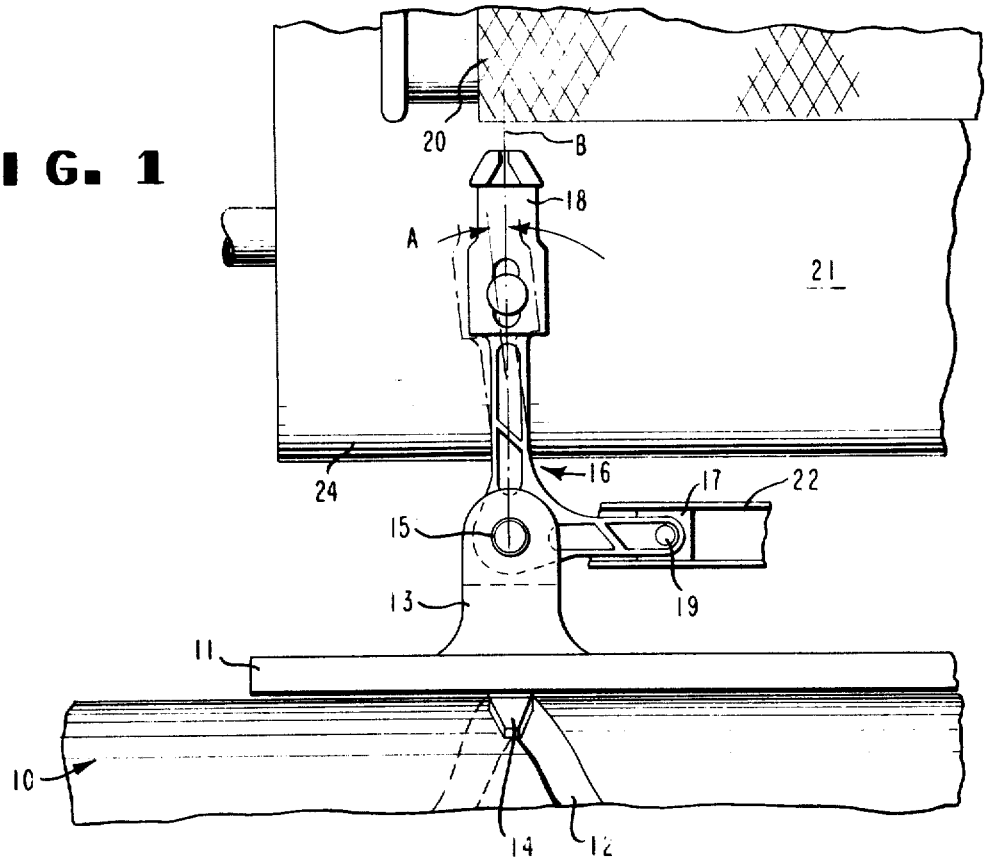
FIG. 1 is a partial front elevation of a winding apparatus showing the flexible arm of the invention.
Figure 2:
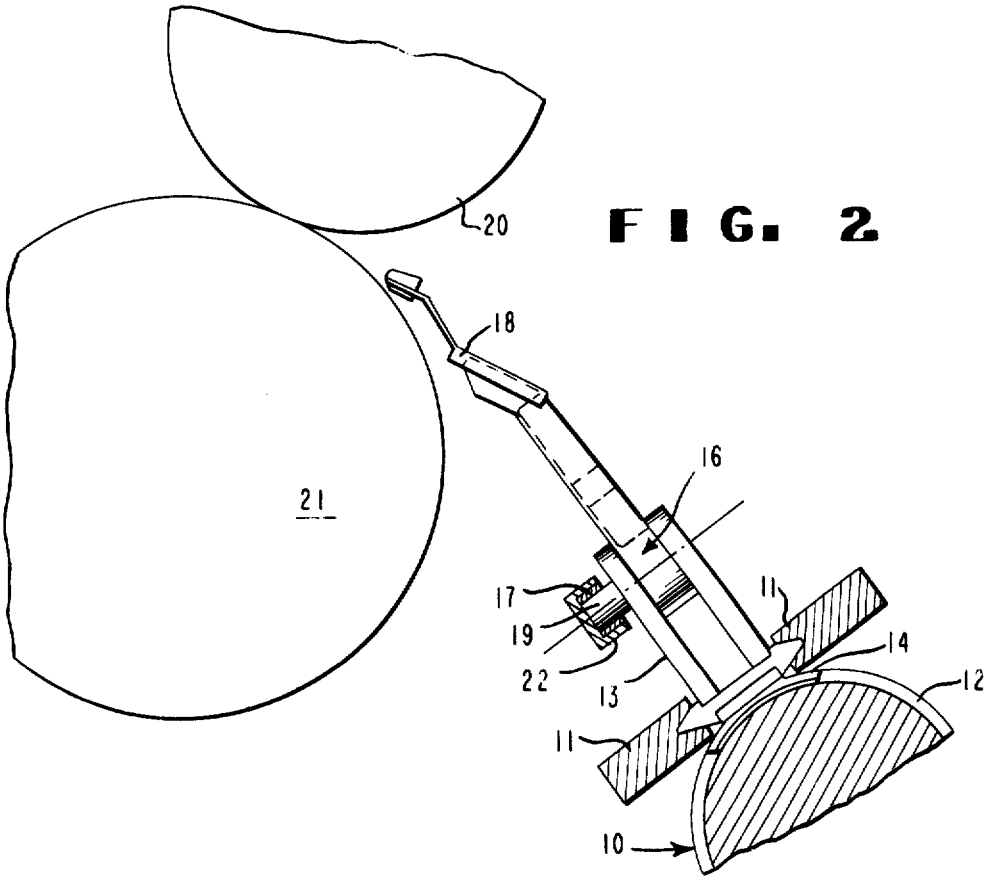
FIG. 2 is a partial side view of FIG. 1.

The winding apparatus chosen for purposes of illustration is similar to the apparatus disclosed by Schippers et al. in U.S. Pat. No. 3,730,448 and is shown in FIGS. 1 and 2. It includes as components thereof a rotatable driven barrel cam 10 having a continuous helical groove 12 in its cylindrical surface, a follower 14 riding in the groove and a combination of a slide head 13, and an L-shaped lever arm 16 attached thereto. A yarn guide 18 is carried by one end of the lever 16 to guide the yarn to be wound onto bobbin 20 driven by drive roll 21 in a particular pattern. To drive lever arm 16, its pivot pin 15 is coupled to a slide head 13 which, in turn, is mounted in guide rail 11 arranged parallel to the bobbin axis. The slide head 13 is attached to follower 14. The slide 13 is constrained by guide rail 11 to a linear path of travel parallel to the surface of the bobbin 20. Arranged on the other end of lever 16 is a slide block 17 which is rotatable about a pin 19 in the lever arm. The block 17 is guided in the guide groove of a guide rail 22 in such a way that during reciprocation of slide 13, the slide block 17 can slide back and forth in guide rail 22.

Figure 3:
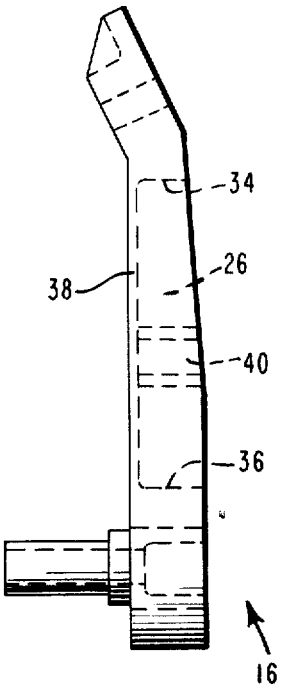
FIGS. 3 and 4 are front and side elevations, respectively, of the flexible arm of the invention.
Figure 4:
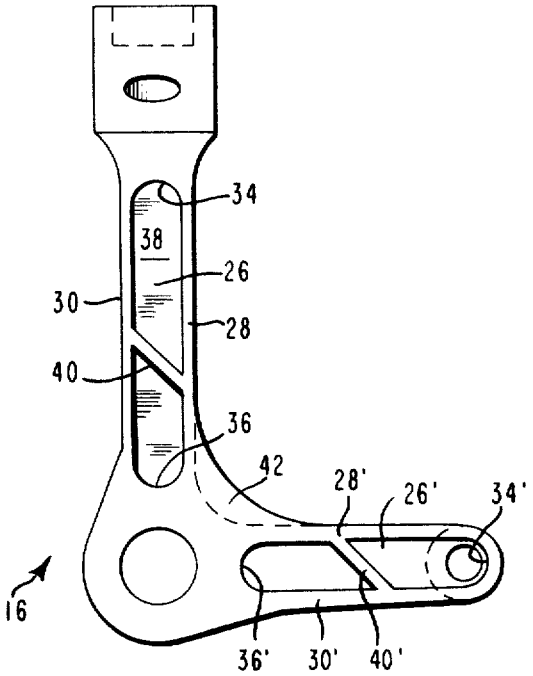

The lever arm 16 is molded from a thermoplastic material such as nylon, Delrin or polypropylene and includes cavities 26, 26' defined by sides 28, 28', 30, 30' radiused end walls 34, 34', 36, 36' and a bottom wall 38 (FIGS. 3 and 4). Diagonally disposed walls 40, 40' extending between sides 28, 30 and 28' 30' respectively divide each cavity into two parts and provide torsional stability. A stiffener web 42 is included between the arms of L-shaped lever 16. The flexibility of lever arm 16 may be varied by varying the thickness of the sides and/or the bottom and diagonally disposed walls of the cavities or web 42.

In operation, as the slide head 13 approaches the end of its stroke at the cam reversal, it begins to slow down. The lever arm 16 being flexible continues to move and thus describes a longer path than the slide member. The flexing of the lever 16 is illustrated in FIG. 1 with the desired limits being an angle A of from about 2.5° to 6.5° where angle A is measured with respect to the centerline of lever 16 and a plane B perpendicular to the leg of lever 16 connected to slide block 17 or perpendicular to the linear path of travel of the lever arm 16 when the guide rail is adjusted to a horizontal position.

In a series of test runs, the lever arm flexibility was determined using high speed photography at 4000 frames/second and compared to prior art traverse guide arrangements. The relative positions of the slide head 13 and the guide 18 are plotted for the prior art arrangement in FIG. 5*a* and for the resilient arrangement of this invention in FIG. 5*b*.

Figure 5A:
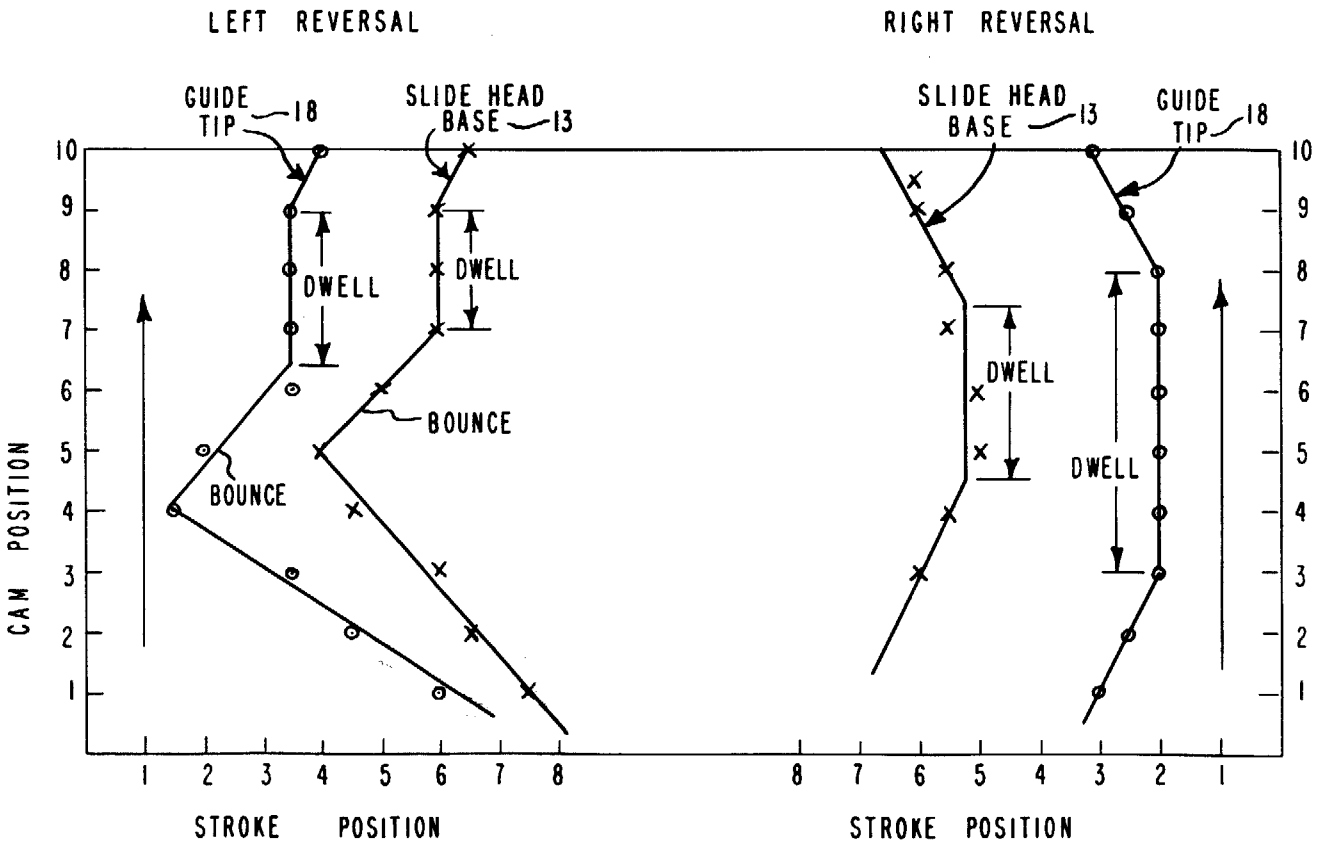
FIG. 5a (Prior Art)
FIGS. 5*a* and *b* are plots of the relative positions of the slide head and the traverse guide tip during reversals of a prior art guide compared to the relative slide head and guide tip positions during reversals using the flexible arm of this invention.
Figure 5B:
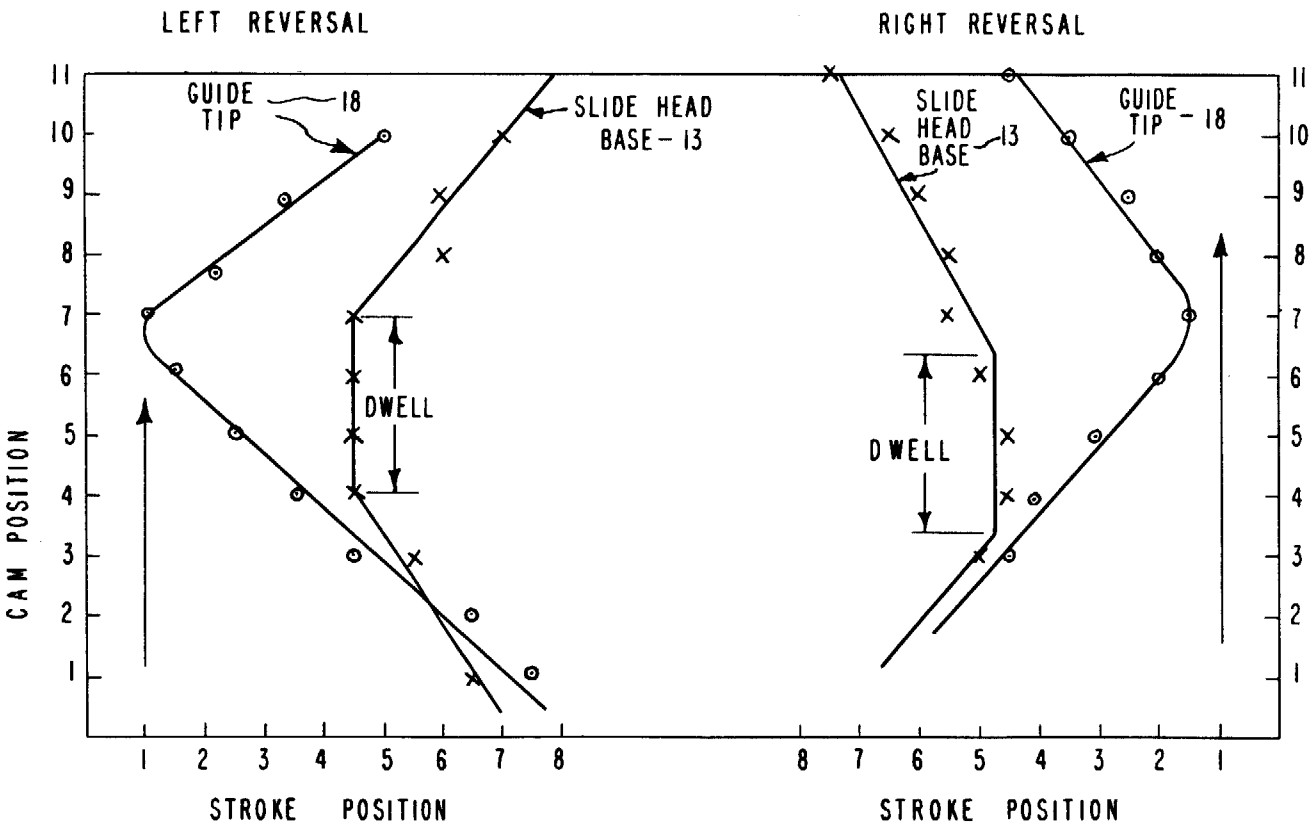

With the prior art assembly (FIG. 5*a*), the slide member and the guide tip track together through the cam reversal. In FIG. 5*a*, the left reversal of the slide head and guide tip differs from the right reversal in showing a perceptible bounce from cam position numbers 4 to 6 at the left reversal which can be attributable to a loose fit between the slide head 13 and the cam 10. FIG. 5*b* shows that the slide head 13 dwells at the reversal, but the guide tip 18 does not. Instead, guide tip 18 undergoes essentially no dwell and follows a smooth reversal.

What is claimed is:

1. In a yarn winding apparatus including a rotatable driven barrel cam having a continuous helical groove in its surface, a cam follower riding in said groove and means limiting the follower to a reciprocating linear path of travel between cam reversal points, a yarn guide and a slide block mounted for reciprocating linear travel the improvement comprising: a resilient L-shaped arm having two legs joined at a junction, said yarn guide being connected to the end of one of said legs, said slide block being connected to the end of the other of said legs, said cam follower being connected to said arm at the junction of said legs, each of said legs being independently flexible, said leg connected to said yarn guide being capable of being flexed at an angle from about 2.5° to about 6.5° with respect to a plane perpendicular to said leg connected to said slide block during the cam reversal, as governed by the flexibility of said legs.

2. The apparatus as defined in claim 1, said arm being molded thermoplastic material.

* * * * *